US009788658B2

(12) United States Patent
King-O'Connor

(10) Patent No.: US 9,788,658 B2
(45) Date of Patent: Oct. 17, 2017

(54) MEDITATION SEAT

(71) Applicant: Sharon Grace King-O'Connor, Huntersville, NC (US)

(72) Inventor: Sharon Grace King-O'Connor, Huntersville, NC (US)

( * ) Notice: Subject to any disclaimer, the term of this patent is extended or adjusted under 35 U.S.C. 154(b) by 0 days.

(21) Appl. No.: 15/360,582

(22) Filed: Nov. 23, 2016

(65) Prior Publication Data

US 2017/0143127 A1 May 25, 2017

Related U.S. Application Data

(60) Provisional application No. 62/259,318, filed on Nov. 24, 2015.

(51) Int. Cl.

| | |
|---|---|
| ***A47C 7/66*** | (2006.01) |
| ***A47C 1/14*** | (2006.01) |
| ***E04H 15/60*** | (2006.01) |
| ***E04H 15/44*** | (2006.01) |
| ***E04H 15/54*** | (2006.01) |
| ***E04H 15/02*** | (2006.01) |
| ***E04H 15/64*** | (2006.01) |
| ***E04H 15/56*** | (2006.01) |

(52) U.S. Cl.

CPC ..... *A47C 7/66* (2013.01); *A47C 1/146* (2013.01); *E04H 15/02* (2013.01); *E04H 15/44* (2013.01); *E04H 15/54* (2013.01); *E04H 15/56* (2013.01); *E04H 15/60* (2013.01); *E04H 15/64* (2013.01)

(58) Field of Classification Search

CPC ..... E04H 15/02; E04H 15/60; E04H 15/64; E04H 15/44; E04H 15/54; A47C 7/66; A47C 1/146

USPC ..... 297/184.15, 184.14; 135/96

See application file for complete search history.

(56) References Cited

U.S. PATENT DOCUMENTS 2,137,427 A * 11/1938 Thomson ..... A47C 4/40 135/96
2,771,125 A * 11/1956 Dobbins ..... A47C 1/146 135/118
3,034,523 A * 5/1962 De Shano ..... E04H 15/48 135/128
3,155,427 A * 11/1964 Necessary ..... A47C 1/16 135/149
3,404,915 A * 10/1968 De Souza Filho .... A47C 1/146 297/17
5,135,281 A * 8/1992 Pappalardo ..... A47C 7/66 135/90

(Continued)

*Primary Examiner* — Milton Nelson, Jr.
(74) *Attorney, Agent, or Firm* — Dunlap Bennett & Ludwig PLLC

(57) ABSTRACT

A mediation seat is provided. The mediation seat includes a first fabric panel including an edge having a first side, a second side, a top and a bottom. At least one pocket is formed about the edge along the first side, the top and the second side. A second fabric panel includes a proximal end, a distal end, a first side and a second side. The proximal end is secured to the top of the first fabric panel. A top end of a first rigid pole is secured to the first side at a distal end of the second fabric panel. A top end of a second rigid pole is secured to the second side at a distal end of the second fabric panel 28. A bendable and flexible pole runs through the at least one pocket running from the first side, through the top and to the second side.

8 Claims, 4 Drawing Sheets

(56) References Cited

U.S. PATENT DOCUMENTS

| | | | | |
|---|---|---|---|---|
| 2007/0018486 | A1* | 1/2007 | Ayers | A47C 7/66<br>297/184.15 |
| 2011/0181078 | A1* | 7/2011 | Kelly | A47C 7/66<br>297/16.1 |

* cited by examiner

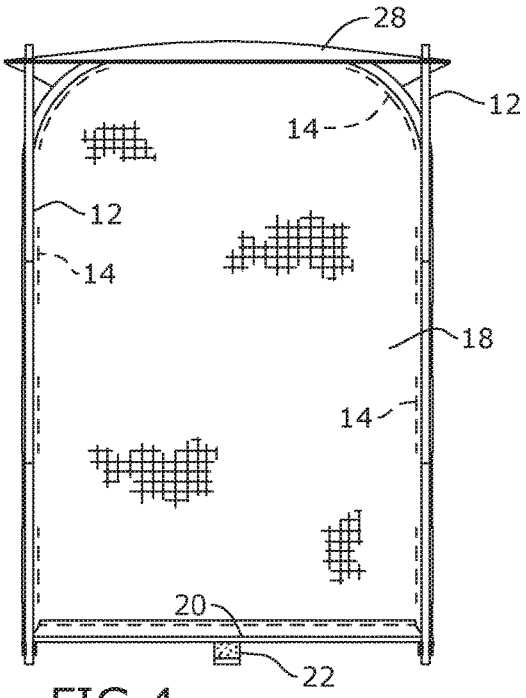
FIG.4
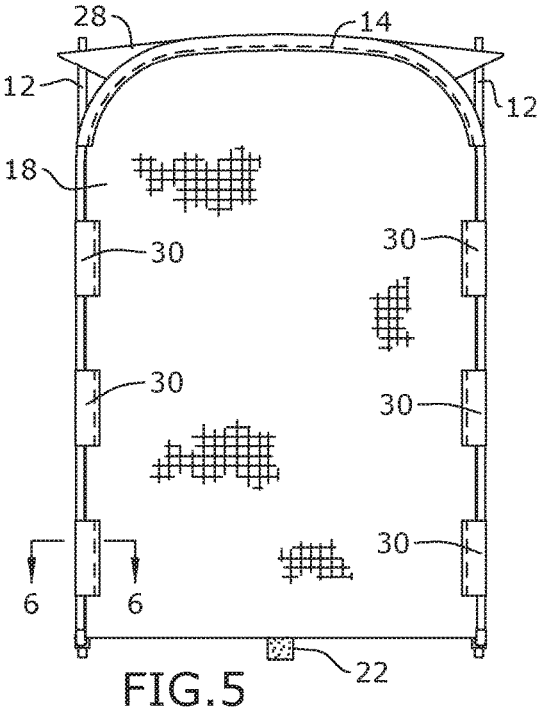
FIG.5
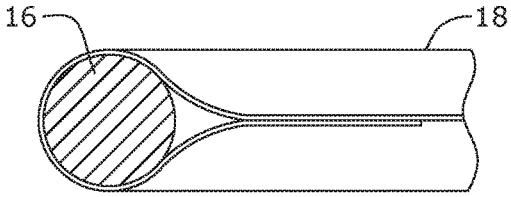
FIG.6
FIG.7
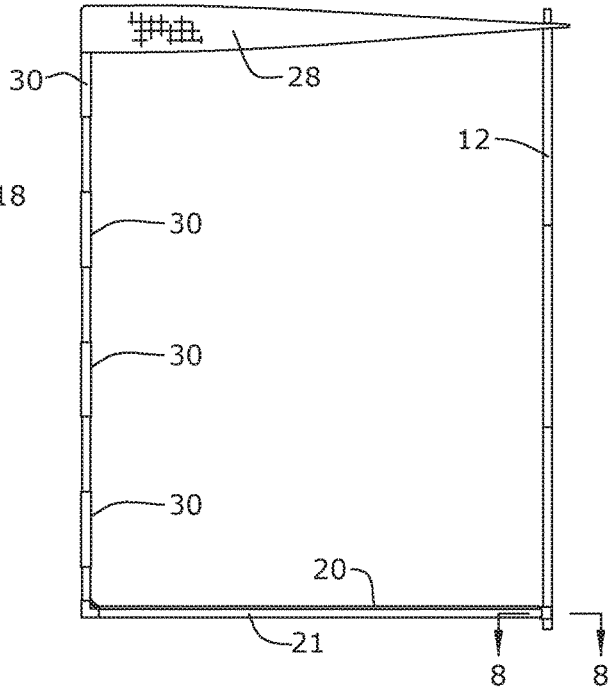

FIG.8
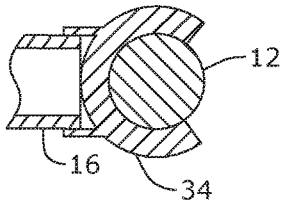
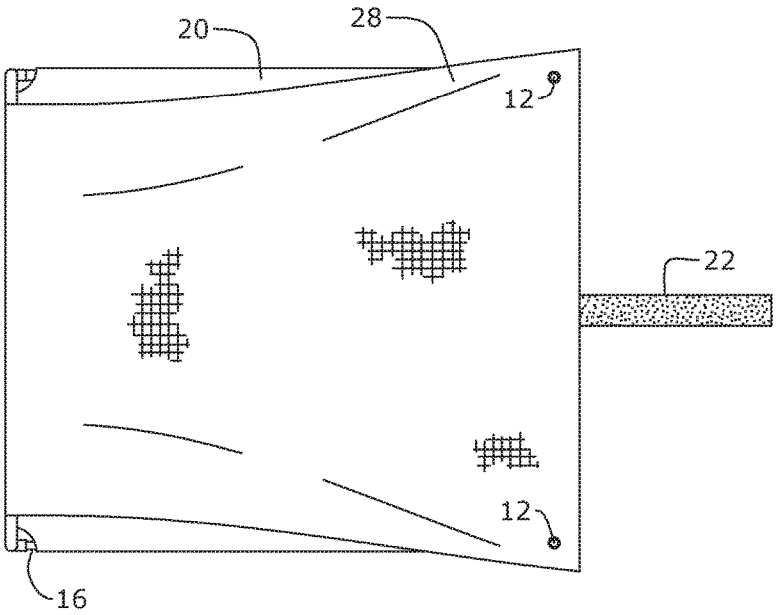
FIG.9
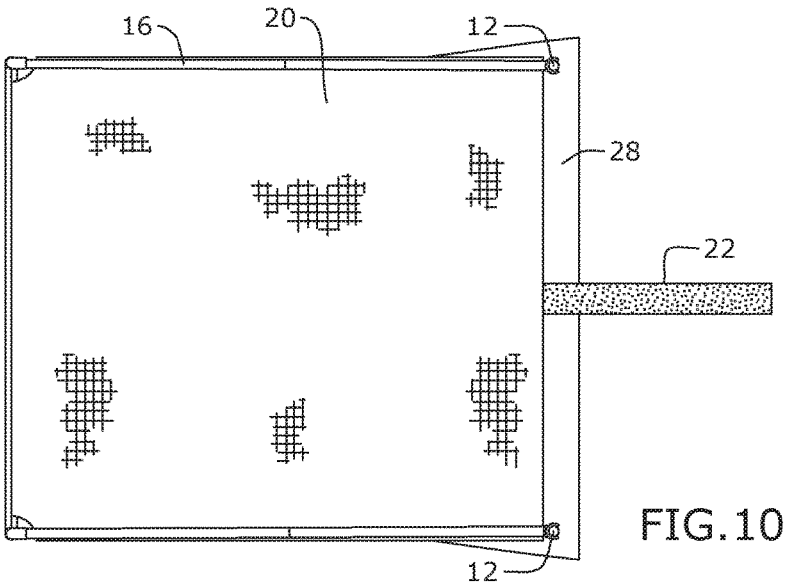
FIG.10

MEDITATION SEAT

CROSS-REFERENCE TO RELATED APPLICATION

This application claims the benefit of priority of U.S. provisional application No. 62/259,318, filed Nov. 24, 2015, the contents of which are herein incorporated by reference.

BACKGROUND OF THE INVENTION

The present invention relates to meditation and, more particularly, to a meditation seat.

Meditation is a practice where an individual trains the mind or induces a mode of consciousness, either to realize some benefit or for the mind to simply acknowledge its content without becoming identified with that content, or as an end in itself. The term meditation refers to a broad variety of practices that includes techniques designed to promote relaxation, build internal energy or life force and develop compassion, love, patience, generosity, and forgiveness. Meditation may be performed outside. Outside meditation exposes one to the elements and on-lookers potentially causing discomfort, which may decrease the benefits of meditation.

As can be seen, there is a need for a covered meditation seat to use in outdoor settings.

SUMMARY OF THE INVENTION

In one aspect of the present invention, a covered meditation seat comprises: a first fabric panel comprising an edge having a first side, a second side, a top and a bottom, wherein at least one pocket is formed along the first side, the top and the second side; a second fabric panel comprising a proximal end secured to the top of the first fabric panel, a distal end, a first side and a second side; a first rigid pole secured to the first side at the distal end of the second fabric panel; a second rigid pole secured to the second side at the distal end of the second fabric panel; and a flexible pole comprising a first end and a second end, wherein the flexible pole runs through the at least one pocket running from the first side, through the top and to the second side.

These and other features, aspects and advantages of the present invention will become better understood with reference to the following drawings, description and claims.

BRIEF DESCRIPTION OF THE DRAWINGS

FIG. 4 is a front view of an embodiment of the present invention;

FIG. 5 is a back view of an embodiment of the present invention;

FIG. 6 is a section view of the present invention taken from 6-6 in FIG. 5;

FIG. 7 is a side view of an embodiment of the present invention with components removed;

FIG. 8 is a section view of the present invention taken from 8-8 in FIG. 7;

FIG. 9 is a top view of an embodiment of the present invention; and

FIG. 10 is a top view of an embodiment of the present invention.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a lightweight weather resistant fabric structure providing meditation support and cover. The present invention provides protection from damp ground, light rain and falling debris, while also providing a sun screen and a deterrent from onlookers. The present invention may further offer comfort and assurance. The present invention provides a connection with natural energy flow and improved airflow around the body, diminishing heat buildup.

The present invention may include about 36-38 inches tall by about 24 inches wide polyester fabric sewn to about a 24 inches wide and 24 inches long polyurethane fabric forming the seat. A pocket may be sewn along the outer edges of the polyester fabric where an interlocking flexible fiberglass pole may be inserted, forming the rigid back structure. The flexible pole may be about 108 inches in length. The outer edges the polyurethane fabric may be hemmed for durability. A second rectangular polyester fabric about 24 by about 24 inches is sewn to the top seam of the back polyester fabric creating a sun shield extension. A grommet is added to each outer edge of the sun shield and supported by the interlocking rigid fiberglass poles, allowing the top half to extend over the person providing a sun shield. The rigid poles may be about 32 inches in height. The present invention may also include a sheath to contain the pod while not in use.

Figure 1:
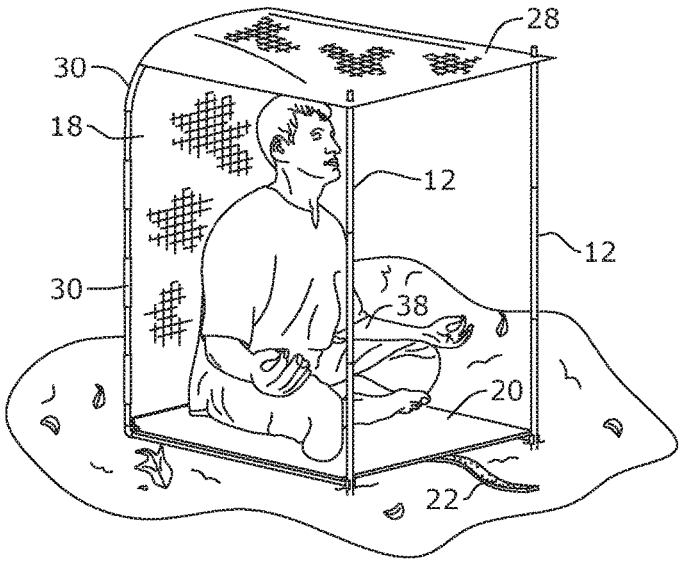
FIG. 1 is a perspective view of an embodiment of the present invention shown in use.
Figure 2:
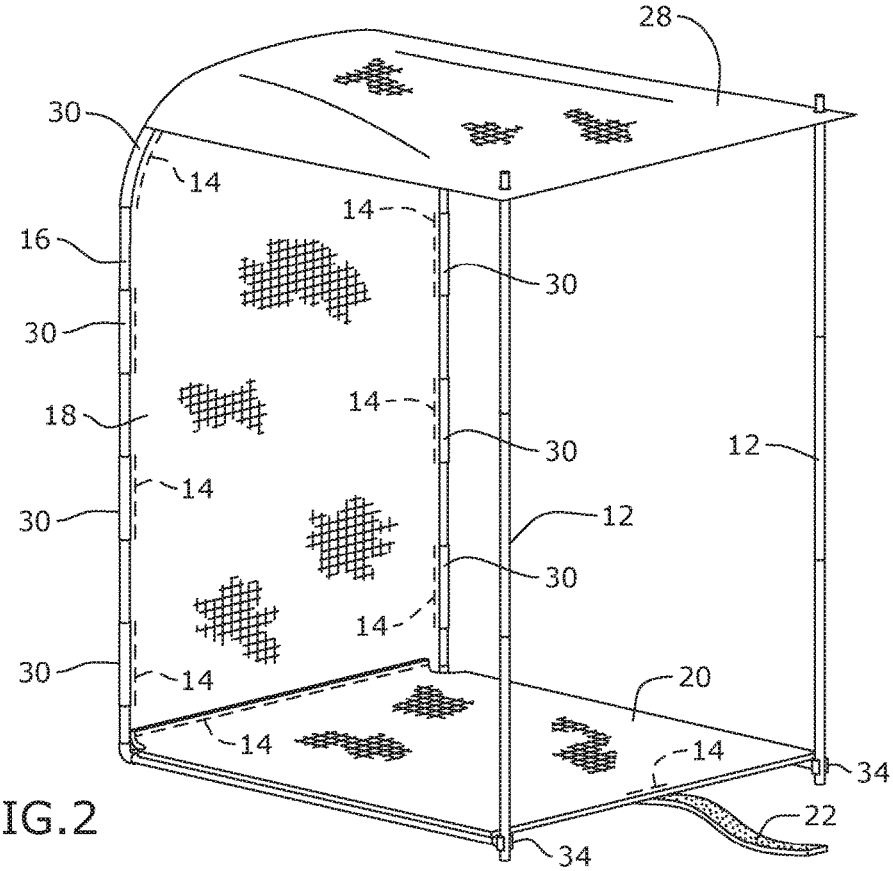
FIG. 2 is a perspective view of an embodiment of the present invention.
Figure 3:
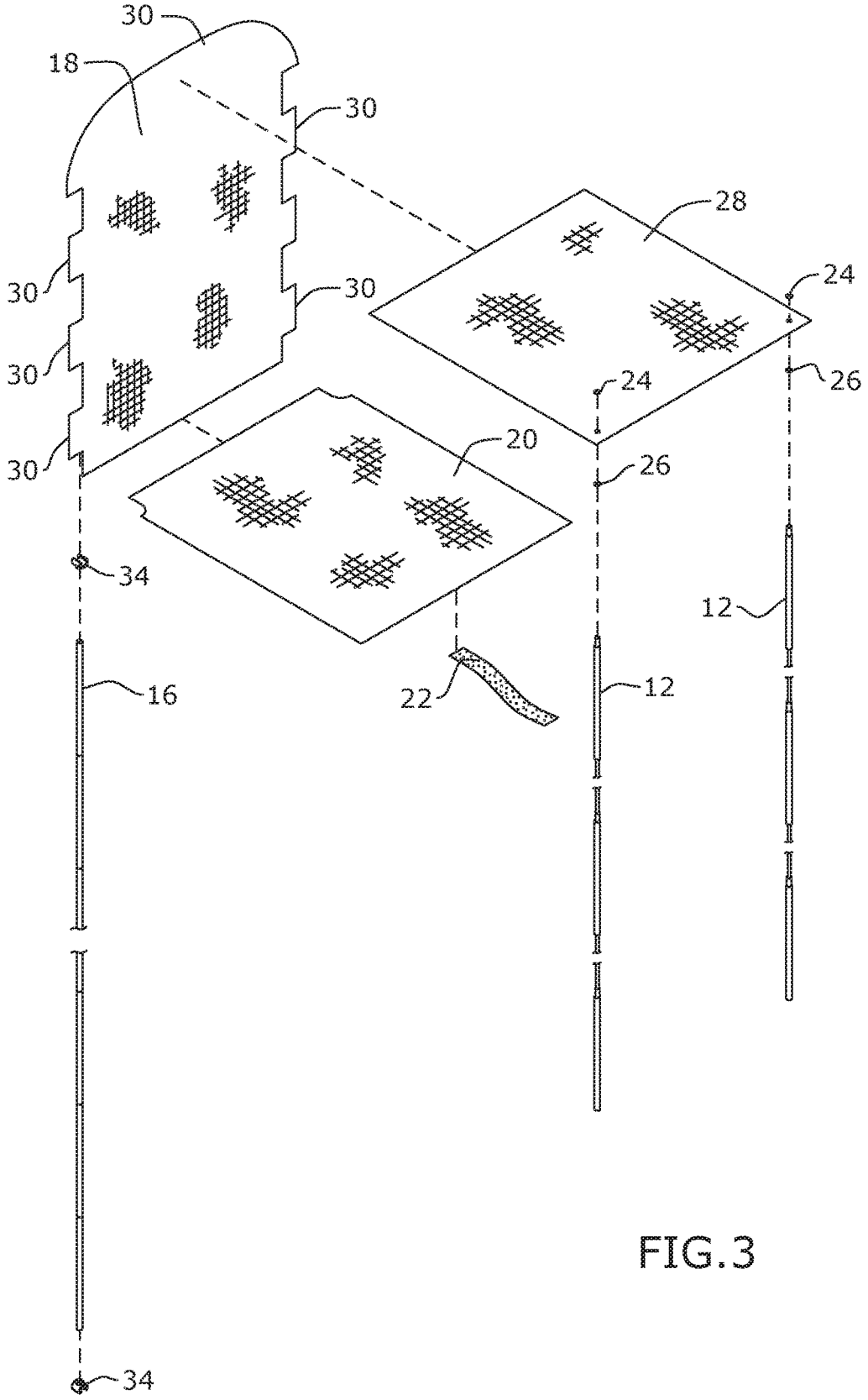
FIG. 3 is an exploded view of an embodiment of the present invention.

Referring to FIGS. 1 through 10, the present invention includes a mediation seat. The mediation seat includes a first fabric panel 18 and a second fabric panel 28. The first fabric panel 18 includes an edge having a first side, a second side, a top and a bottom. At least one pocket 30, such as a plurality of pockets 30 may be formed about the edge along the first side, the top and the second side. The pockets 30 may be formed by folding over the edge of the first fabric panel 18 and securing the edge to the first fabric panel 18 by stitching 14. The folded over edge forms a looped pocket. The second fabric panel 28 includes a proximal end, a distal end, a first side and a second side. The proximal end is secured to the top of the first fabric panel 18. For example, the proximal end may be secured to the top of the first fabric panel 18 by stitching 14. The fabric panels 18 may be made of a waterproof material, such as polyester.

The mediation seat may be secured in an erect position by using a plurality of poles 12, 16. The present invention may include a first rigid pole 12 and a second rigid pole 12, each having a top end and a bottom end. The top end of the first rigid pole 12 is secured to the first side at a distal end of the second fabric panel 28 and the bottom end may rest on the ground. The top end of the second rigid pole 12 is secured to the second side at a distal end of the second fabric panel 28 and the bottom end may rest on the ground. The present invention further includes a bendable and flexible pole 16. The flexible pole 16 includes a first end and a second send. The flexible pole 16 runs through the at least one pocket 30 running from the first side, through the top and to the second side. The first end and the second end may be secured to the ground.

The rigid poles 12 may fit within grommets 24, 26 attached to the second fabric panel 28. For example, a male grommet 24 may secure to a female grommet 26 at two corners of the second fabric panel 28. The corners may be located near the distal end at the first and second side. In such embodiments, the bottom end of the first rigid pole 12 rests on the ground and the top end of the first rigid pole 12 fits within one of the grommets 24, 26. The bottom end of the second rigid pole 12 rests on the ground and the top end of the second rigid pole 12 fits within the other of the grommets 24, 26.

In certain embodiments, the rigid poles 12 may be formed of a plurality of rigid segments. Each of the rigid segments may be hollow. An internal elastic cord may run through the rigid hollow segments connecting them together. Further, the flexible pole 16 may be formed of a plurality of flexible segments. Each of the flexible segments may be hollow. An elastic cord may run through the flexible hollow segments connecting them together. The segments allow a user 36 to quickly assemble the poles 12, 16 into an erect position and disassembled the poles 12, 16 to a compact position.

The present invention may further include a mat 20. In certain embodiments, the mat 20 may be padded. For example, the padded mat 20 may be formed of a polyurethane foam material. The mat 20 is disposed underneath the second fabric panel 28, as the second panel 28 acts as a cover for the user 36 sitting on the mat 20. In certain embodiments, the mat 20 may be connected to the bottom of the first fabric panel by stitching 14. The stitching 14 may be made of an anti wicked thread.

The present invention may include a first connector pole 21 and a second connector pole 21. The first connector pole 21 may include a first end releasably secured to the flexible pole 16 and a second end releasably secured to the first rigid pole 12. The second connector pole 21 may include a first end releasably secured to the flexible pole 16 and a second end releasably secured to the second rigid pole 12. The first end and the second end of each of the first connector pole 21 and the second connector pole 21 includes a crab claw connector 34. The crab claw connectors 34 include a C shape with flexible arms that wrap around and snap onto the poles 12, 16.

In a compact form, the connector poles 21 are detached, the flexible pole 16 is removed from the pockets 30 and the rigid poles 12 are removed from the grommets 24, 26. A strap 22 extends from the distal end of one of the padded mat 20 and the second fabric panel 28. As illustrated in the Figures, the strap 22 extends from the padded mat 20. The strap 22 includes a connector, such as a hook and loop fastener, a snap button, a clip and the like. The padded mat 20, the first fabric panel 18 and the second fabric panel 28 may be rolled up and the strap 22 may secure the panels 18, 28 and mat 20 in a rolled configuration.

It should be understood, of course, that the foregoing relates to exemplary embodiments of the invention and that modifications may be made without departing from the spirit and scope of the invention as set forth in the following claims.

What is claimed is:

1. A meditation seat comprising:

a first fabric panel comprising an edge having a first side, a second side, a top and a bottom, wherein at least one pocket is formed along the first side, the top and the second side;

a second fabric panel comprising a proximal end secured to the top of the first fabric panel, a distal end, a first side and a second side;

a first rigid pole secured to the first side at the distal end of the second fabric panel;

a second rigid pole secured to the second side at the distal end of the second fabric panel; and a flexible pole comprising a first end and a second end, wherein the flexible pole runs through the at least one pocket running from the first side of the first fabric panel, through the top of the first fabric panel and to the second side of the first fabric panel.

2. The meditation seat of claim 1, further comprising a padded mat disposed underneath the second fabric panel.

3. The meditation seat of claim 2, wherein the padded mat comprises a proximal end and a distal end, wherein the proximal end is stitched to the bottom of the first fabric panel.

4. The meditation seat of claim 3, further comprising a strap extending from the distal end of one of the padded mat and the second fabric panel, wherein the strap comprises a hook and loop fastener.

5. The meditation seat of claim 1, further comprising:

a first connector pole comprising a first end releasably secured to the flexible pole and a second end releasably secured to the first rigid pole; and a second connector pole comprising a first end releasably secured to the flexible pole and a second end releasably secured to the second rigid pole.

6. The meditation seat of claim 5, wherein the first end and the second end of each of the first connector pole and the second connector pole comprises a crab claw connector.

7. The meditation seat of claim 1, further comprising a first grommet and a second grommet secured to the second fabric panel, wherein a top end of the first rigid pole fits within the first grommet and a top end of the second rigid pole fits within the second grommet.

8. The meditation seat of claim 1, wherein the first rigid pole and the second rigid pole each comprise a plurality of rigid segments and an internal elastic cord.

* * * * *